US005646665A

United States Patent [19]

Swanson et al.

[11] Patent Number: 5,646,665

[45] Date of Patent: Jul. 8, 1997

[54] SIDE BIASED DATUM SCHEME FOR INKJET CARTRIDGE AND CARRIAGE

[75] Inventors: David W. Swanson, Escondido; Jeffrey A. Thoman, San Diego; W. Wistar Rhoads; Jaren D. Marler, both of Escondido, all of Calif.

[73] Assignee: Hewlett-Packard Company, Palo Alto, Calif.

[21] Appl. No.: 57,241

[22] Filed: Apr. 30, 1993

[51] Int. Cl.[6] ..... B41J 2/175

[52] U.S. Cl. ..... 347/87

[58] Field of Search ..... 347/87

[56] References Cited

U.S. PATENT DOCUMENTS

| | | | |
|---|---|---|---|
| 4,709,246 | 11/1987 | Piatt et al. | 347/87 |
| 4,709,247 | 11/1987 | Piatt et al. | 347/86 |
| 4,755,836 | 7/1988 | Ta et al. | 347/87 |
| 4,872,026 | 10/1989 | Rasmussen et al. | 347/87 |
| 4,907,018 | 3/1990 | Pinkerpell et al. | 347/87 |
| 4,998,115 | 3/1991 | Nevarez et al. | 347/87 |
| 5,237,342 | 8/1993 | Saikawa et al. | 347/87 |
| 5,278,584 | 1/1994 | Keefe et al. | 347/87 |

*Primary Examiner*—Valerie Lund

[57] ABSTRACT

An ink jet printer includes a movable carriage supported above an ink-receiving medium by a rail defining a carriage axis, with a cartridge holder mounted on said carriage having a plurality of cartridge compartments each receiving a respective thermal ink jet printer cartridge. Each cartridge is provided with three datum surfaces located on the perimeter of a sidewall of the cartridge, and sufficiently spaced apart from each other and from the center of gravity of the cartridge to provide accurate and stable alignment. More particularly, the nozzle plate of the cartridge is attached to a lower surface of snout portion such that the Y axis of the nozzle plate is substantially parallel to the first sidewall, with the first and second datum surfaces at the front and rear of a lower end of the ink reservoir portion straddling the snout and the third datum surface at an upper end of the ink reservoir portion. At least the first and second datum surfaces are spaced from the Y axis within a predetermined tolerance by a first predetermined spacing. The cartridge is also provided with a forwardly facing fourth datum surface on a lower end of the ink reservoir portion in front of the snout portion, and with a downwardly facing fifth datum surface on the perimeter wall of the ink reservoir portion adjacent the fourth datum surface and above said snout portion, so as to establish a pivot axis above and in front of the snout, and with a rearwardly facing sixth datum surface on an upper end of the ink reservoir portion of said perimeter wall. The fourth datum surface is spaced from the X axis of the nozzle plate within a predetermined tolerance, while the locations of the fifth datum surface (which is used to determine the spacing of the nozzle to the print medium) and the sixth datum surfaces (which is used to determine angular orientation of the cartridge about the pivot point) are somewhat less critical.

12 Claims, 9 Drawing Sheets

102
98
104
108
100
18
96
94
78
80
82
16

SIDE BIASED DATUM SCHEME FOR INKJET CARTRIDGE AND CARRIAGE

TECHNICAL FIELD

The present invention relates generally to inkjet printers having multiple printing cartridges each having its own nozzle assembly and ink reservoir, and more particularly to a cartridge datum scheme for ensuring accurate and stable alignment of the cartridges when installed in a printer having a multiple compartment cartridge holder.

CROSS-REFERENCE TO RELATED APPLICATIONS

For a more comprehensive view of what is presently regarded as the best mode of practicing the invention and its intended environment, reference should be made to the following commonly assigned U.S. patent applications (and the patents and patent applications referenced therein):

J. Thoman et al, "Datum Machining & Structure", filed concurrently herewith (Attorney Docket No. HP 1092629-1); and D. W. Swanson et al, "Thin Pen Structure for Thermal Ink-jet Printer", U.S. Ser. No. 07/994,809 filed 22 Dec. 1992 (Attorney Docket HP 1092607-1).

In addition, the following commonly assigned U.S. patent application claims an invention which, although believed to be patentably distinguishable, may be related to the present invention:

W. W. Rhoads, "Spring Cartridge Clamp for Inkjet Printer Carriage", filed concurrently herewith (Attorney Docket HP 1093061-1)

and accordingly, is also hereby incorporated by reference.

BACKGROUND ART

From U.S. Pat. No. 4,755,836 it is known to provide an inkjet printer with a pair of replaceable printing cartridges (each having at least one nozzle assembly and associated ink reservoir) mounted on a common carriage, and to maintain registration between the cartridges and the carriage by means of alignment and registration features such as protuberances, shims, opening and surfaces. A latch mechanism provides a loading force in all three coordinate axes and cooperates with the registration and alignment features to prevent pitch, yaw and roll of the cartridge.

That prior art registration and latching system was designed for use with two relatively wide cartridges (one containing three colors of ink, each in a separate ink reservoir and applied by a separate set of ink nozzles), and located all the alignment and registration feature in the vicinity of the nozzle plate assembly. Because it was relatively wide and short, the prior art cartridge could be maintained in a predetermined spatial orientation within reasonable limits without imposing exceedingly tight tolerances on the locations of the various alignment and registrations features, and had sufficient stability to maintain the cartridge in that predetermined spatial orientation, even when subjected to sideways inertial forces when the carriage was accelerated or decelerated; however, especially if used with more than two cartridges, the prior art design would result in a printer having a wide footprint, and is not readily adaptable for use with four relatively tall and narrow cartridges.

From U.S. Pat. No. 4,872,026 it is known to facilitate the installation of a single inkier cartridge by providing a lower pivot below an electrical interface, adjacent the intersection of the contact and nozzle planes, with the cartridge being held in its installed position by an upper latch spring. Although that design is intended to provide some wiping action between the electrical contacts as the cartridge is loaded into position, such wiping is relatively minimal because of the close proximity of the pivot point to the contact plane. Moreover, because the pivot of the prior art design had to cooperate with a corresponding supporting structure on the carriage, it was not possible to include any mechanism for tensioning the ink receiving media in the immediate vicinity of the nozzle, thereby exacerbating any tendency of the media to buckle and requiring a greater than optimum spacing from the nozzle.

U.S. Pat. No. 4,709,247 discloses a non-mechanical alignment and registration scheme for a multiple cartridge inkjet printer which automatically measures alignment errors in a test pattern and computes corresponding data adjustments to be used in a subsequent printing operation.

SUMMARY OF THE INVENTION

In accordance with one overall aspect of the present invention, an ink jet printer includes a movable carriage supported above an ink-receiving medium by a rail defining a carriage axis, with a cartridge holder mounted on said carriage having a plurality of cartridge compartments each receiving a respective thermal ink jet printer cartridge; each cartridge includes a respective nozzle plate, and three datum surfaces on the side of each of the cartridges cooperate with respective supporting surfaces on a sidewall of its respective compartment, to maintain the cartridges parallel to each other with a predetermined spacing between the Y axes on each respective nozzle when a sideways bias force is applied to each cartridge.

In accordance with other more specific aspects, each of the cartridges are provided with three additional datum surfaces, including adjacent horizontal and vertical datum surfaces above the snout of the cartridge, which cooperate with corresponding supporting surfaces defined in a bottom wall of its the respective compartment to maintain the required spacing between the nozzle plate and the ink receiving media below the carriage and to align the respective nozzles relative to a common X axis, and a sixth datum surface located at the upper rear of the cartridge. The cartridge is installed by pushing it into its compartment with a natural downward motion until the horizontal datum surface contacts the corresponding supporting surface on the bottom of the cartridge compartment, and then rotating the cartridge rearwardly about a pivot point defined by the intersection of the horizontal and vertical datum surfaces with a natural rearward motion until the sixth datum surface contacts the corresponding supporting surfaces on the rear of the cartridge compartment. Because the pivot axis is located above and in front of the snout, the electrical interface at the lower rear of the cartridge moves downwards as the cartridge is rotated rearwardly about the pivot access during installation, thereby providing an enhanced self-cleaning wiping action between the electrical contact surfaces on the cartridge and the cartridge holder.

In accordance with a second overall aspect of the invention, a cartridge for a ink jet printer is provided with three datum surfaces located on the perimeter of a sidewall of the cartridge, and sufficiently spaced apart from each other and from the center of gravity of the cartridge to provide accurate and stable alignment. More particularly, the nozzle plate of the cartridge is attached to a lower surface of snout portion such that the Y axis of the nozzle plate is substantially parallel to the first sidewall, with the first and second datum surfaces at the front and rear of a lower end of the ink reservoir portion straddling the snout and the third datum surface at an upper end of the ink reservoir portion. At least the first and second datum surfaces are spaced from the Y axis within a predetermined tolerance by a first predetermined spacing.

In accordance with still other more specific aspects, the cartridge is also provided with a forwardly facing fourth datum surface on a lower end of the ink reservoir portion in front of the snout portion, a downwardly facing datum surface on the perimeter wall of the ink reservoir portion adjacent the fourth datum surface and above said snout portion so as to establish a pivot axis above and in front of the snout, and a rearwardly facing sixth datum surface on an upper end of the ink reservoir portion of said perimeter wall. The fourth datum surface is spaced from the X axis of the nozzle plate within a predetermined tolerance, while the locations of the fifth datum surface (which is used to determine the spacing of the nozzle to the print medium) and the sixth datum surfaces (which is used to determine angular orientation of the cartridge about the pivot point) are somewhat less critical. The cartridge also preferably includes a reenforcing bracket for supporting the fourth datum surface which is integrally formed in said perimeter wall at a juncture of a downwardly facing surface of the ink reservoir portion and a forwardly facing portion of the snout portion.

BRIEF DESCRIPTION OF THE DRAWINGS

Other objects and features of the present invention will be apparent from the following description of a presently preferred embodiment taken in connection with the accompanying drawings, in which:

FIG. 2 comprising

FIG. 3 comprising

FIG. 10 comprising

DETAILED DESCRIPTION OF THE PREFERRED EMBODIMENT

Figure 1:
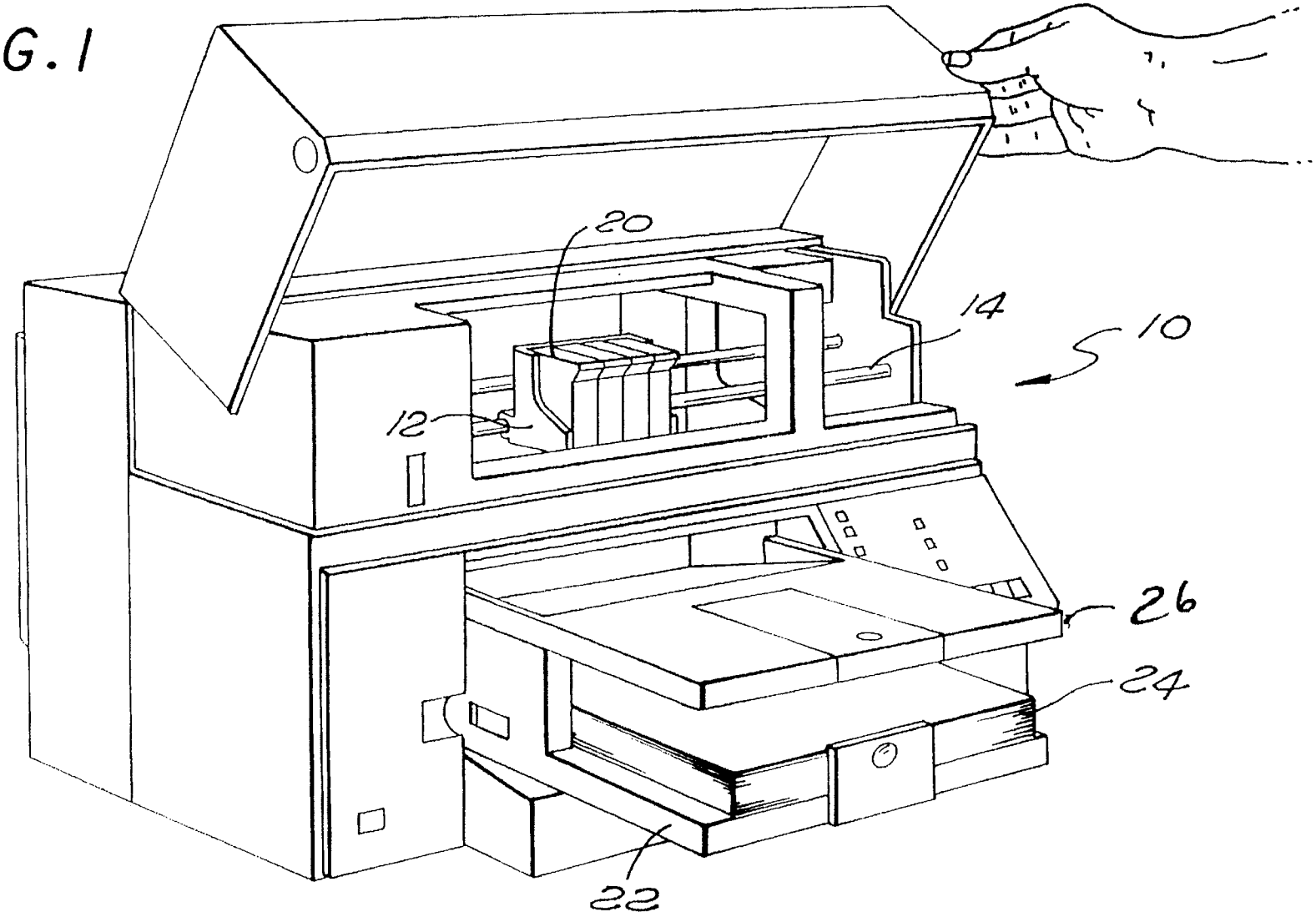
FIG. 1 is an isometric view showing the major components of an inkjet printer incorporating the present invention.
Figure 5:
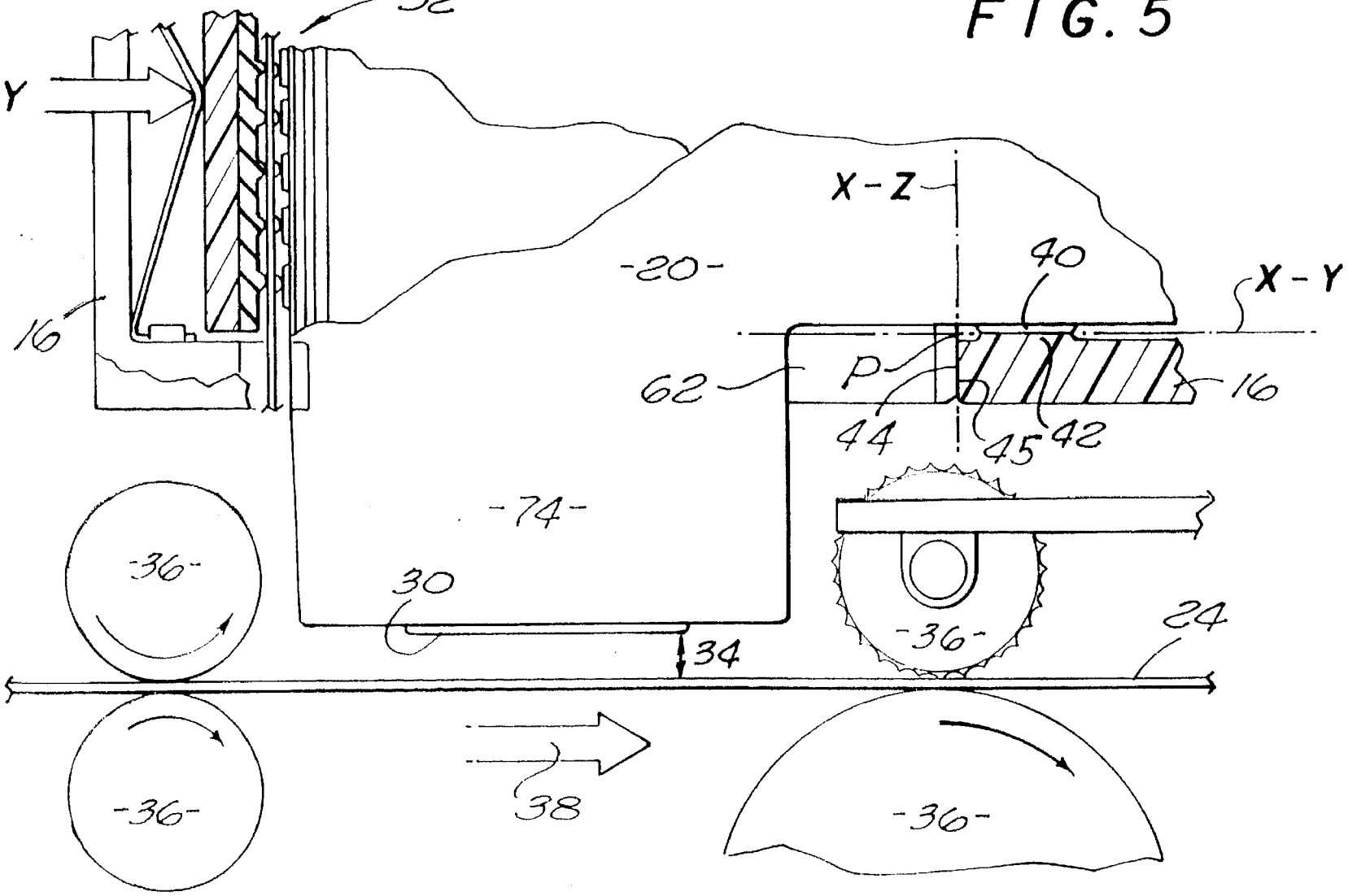
FIG. 5 is another side view, partly in cross section, showing the cartridge and a corresponding portion of the cartridge holder with their respective contacts engaged to thereby provide a registration force in the Y axis, and also showing the snout of the cartridge in its operational position relative to an advancing sheet of print media.

FIG. 1 shows a small footprint, high quality inkjet printer 10 incorporating the present invention. In particular, inkjet printer 10 includes a movable carriage 12 supported on a rail 14. As best shown in FIG. 2C, movable carriage 12 includes a cartridge holder 16 provided with a plurality of individual cartridge compartments 18 for receiving a respective plurality of thermal ink jet printer cartridges 20. Inkjet printer 10 also is provided with input tray 22 containing a number of sheets of bond paper or other suitable ink-receiving medium 24, and an upper output tray 26 for receiving the printed media. As best shown in FIG. 5, each cartridge 20 is supported above the ink-receiving medium 24 by the cartridge holder 16, such that a nozzle plate 30 on lower surface 32 (FIG. 3B) is maintained an appropriate distance 34 from ink-receiving medium 24. As is conventional in inkjet printers, inkjet printer 10 is also provided with feed rollers 36 which maintain the print medium 24 in a taut condition as it passes under the nozzle plate 30, and which advance ink-receiving medium 24 in a direction 38 perpendicular to the carriage axis defined by rail 14.

Figure 2A:
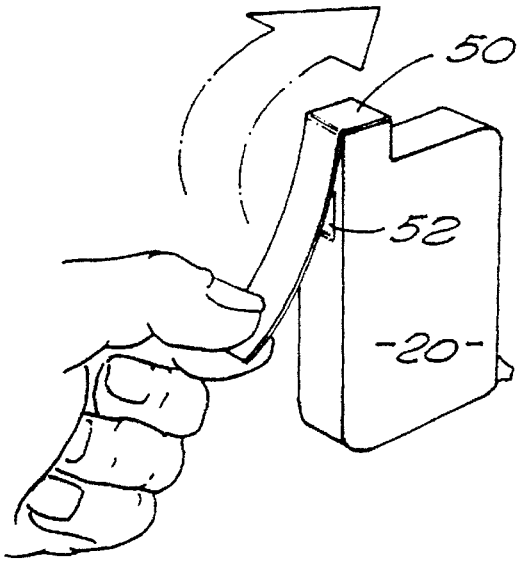
FIGS. 2A, 2B, and 2C are isometric views showing one of printer "cartridges" of FIG. 1 being inserted into a corresponding slot of the cartridge holder.
Figure 2B:
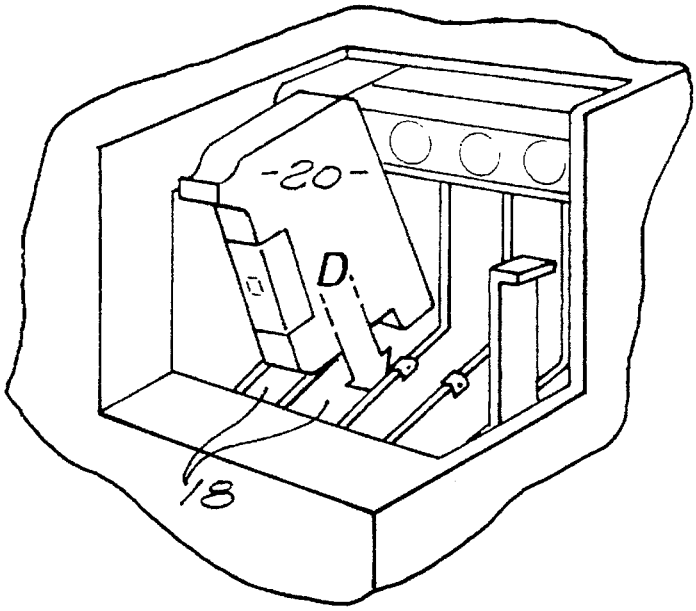
Figure 2C:
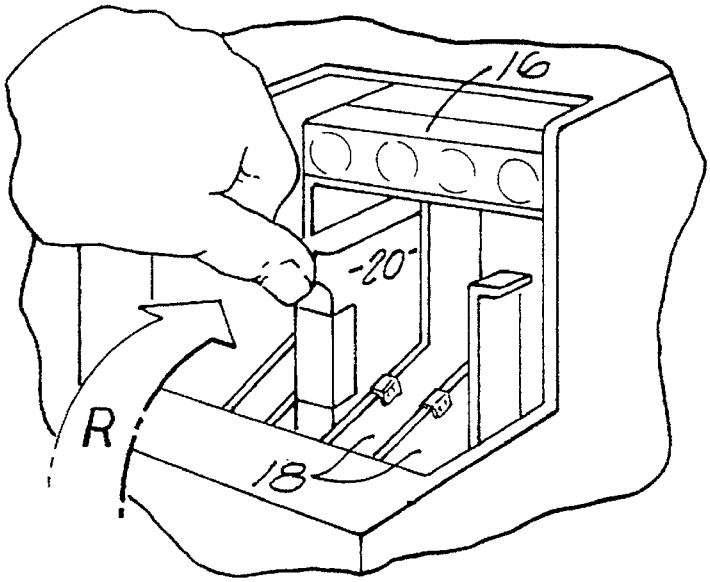

Referring now to FIG. 2, comprising FIGS. 2A, 2B, and 2C, it will be seen that cartridge 20 is installed by pushing it into its cartridge compartment 18 with a natural downward motion D until its horizontal datum surface 40 (see FIGS. 4 and 5) contacts the corresponding supporting surface 42 on the bottom of the cartridge compartment 18, and then rotating the cartridge 20 rearwardly (FIG. 2C) about a pivot point P (FIG. 5) in the vicinity of the intersection of the horizontal and vertical datum surfaces 40, 44 (FIG. 5) with a natural rearward motion R until an upper datum surface 46 (FIG. 4) contacts a corresponding supporting surface 48 on the upper rear of the cartridge compartment. As shown in FIG. 2A, cartridges 20 are preferably provided with a protective strip 50 which is removed prior to installation to expose the contact surface of an electrical interface 52 carried on rear surface of cartridges 20, as well as nozzle plate 30 (FIG. 3).

Figure 3A:
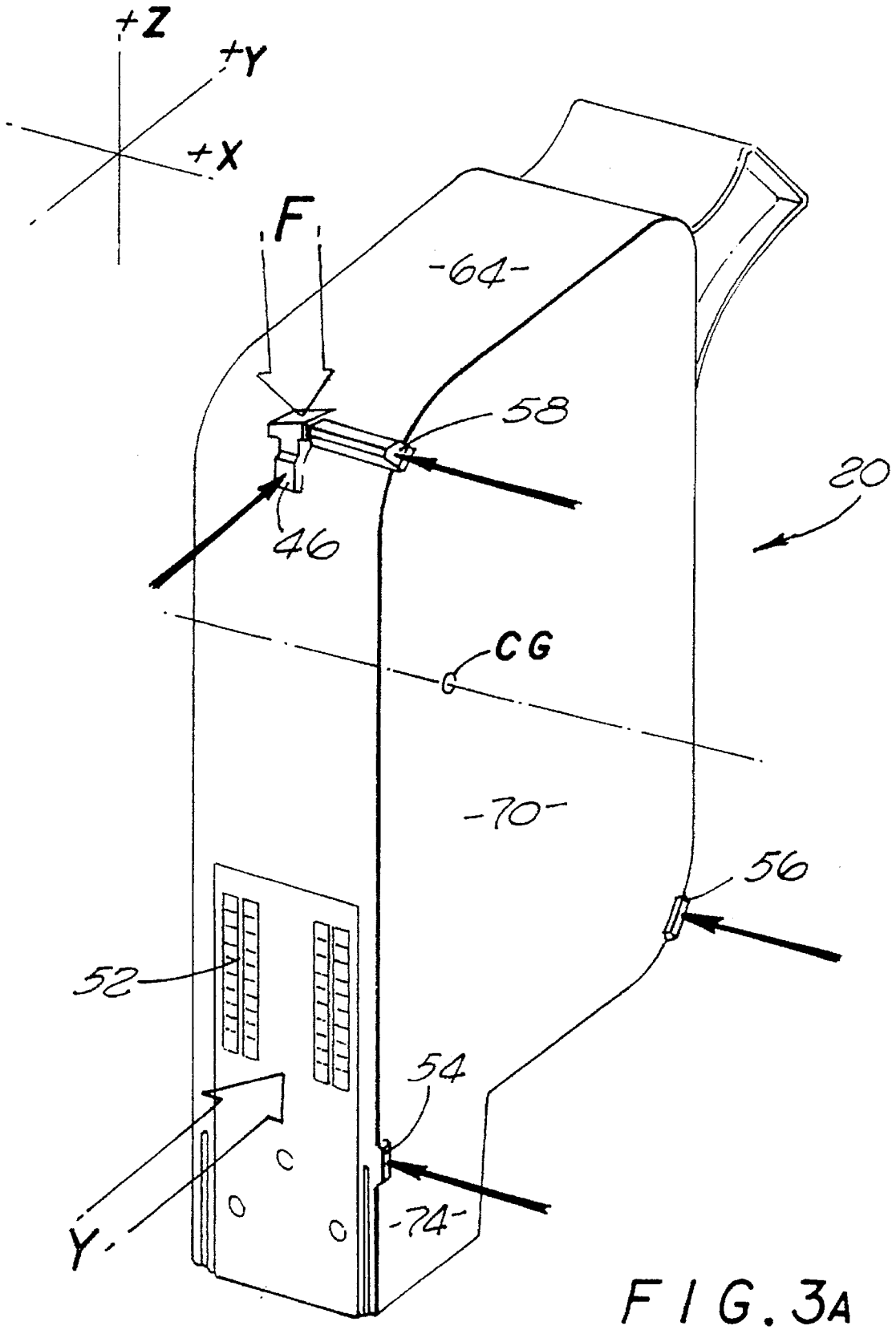
FIGS. 3A and 3B are isometric views of the cartridge of FIG. 2 as seen from the top rear and bottom front, respectively, and show the six "datum" surfaces provided in the cartridge, as well as the various registration forces which are applied to the cartridge to maintain these surfaces against corresponding registration features provided in the cartridge holder.
Figure 3B:
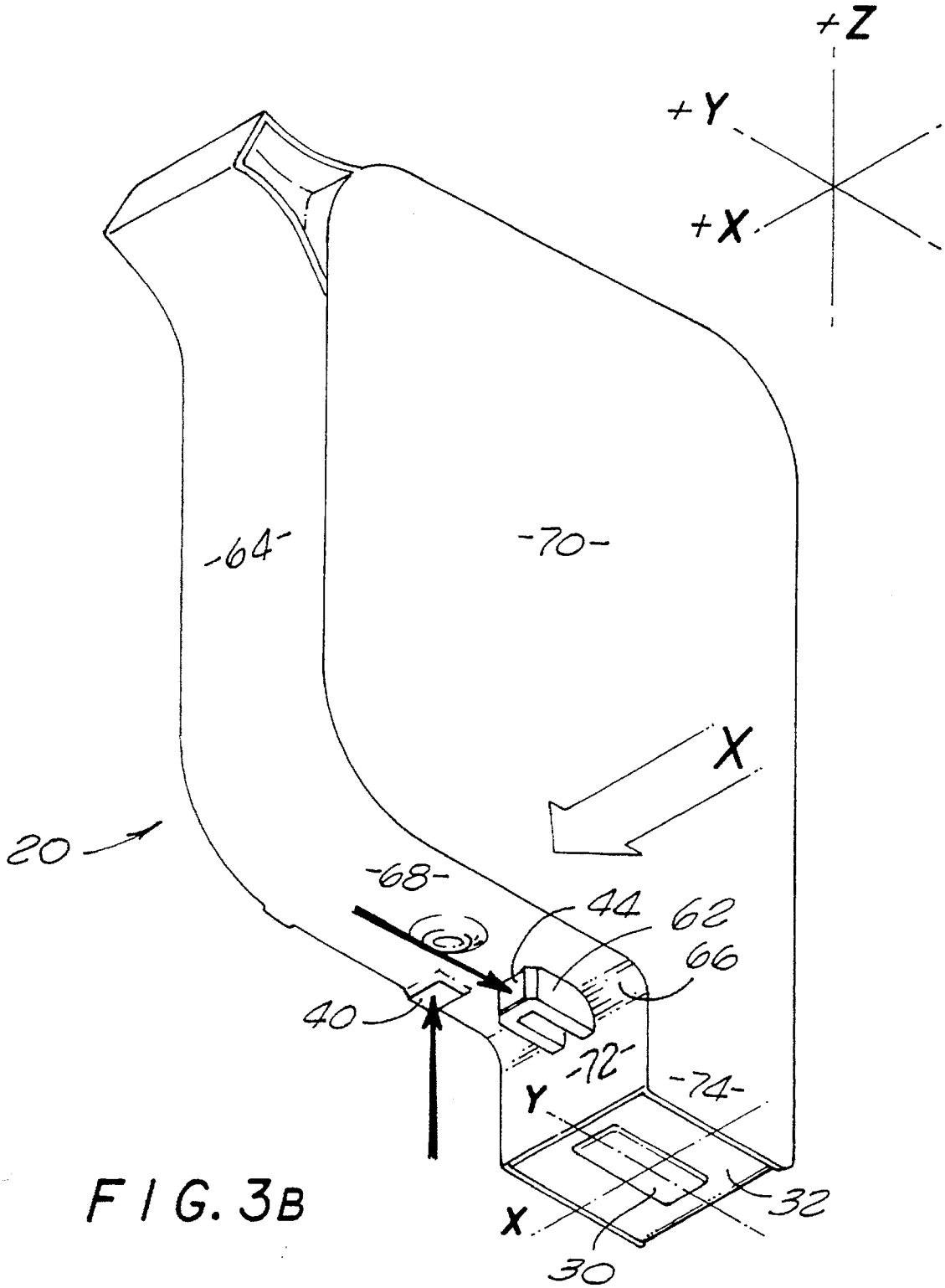
Figure 4:
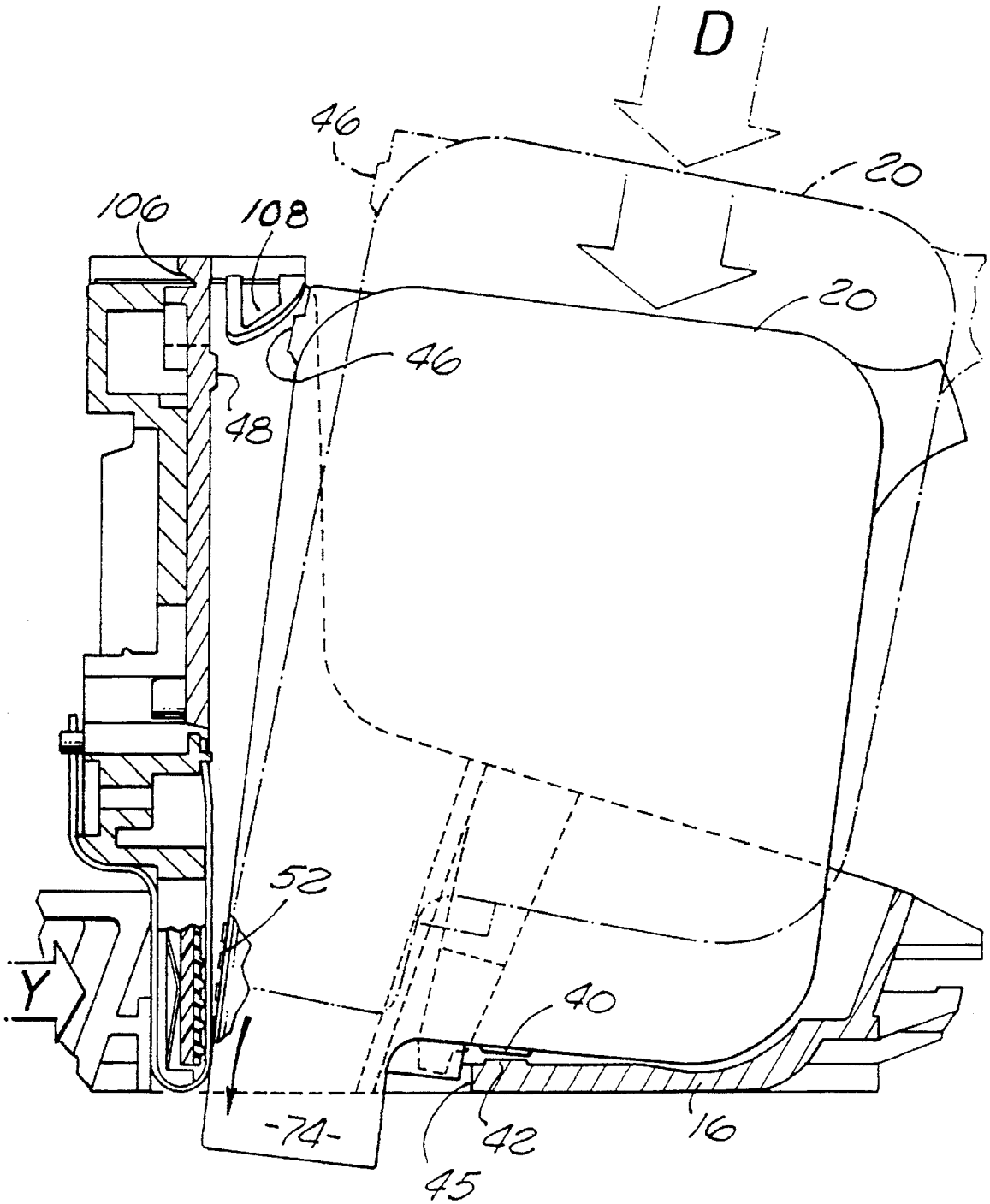
FIG. 4 is a side view, partly in cross section, of the cartridge and a corresponding portion of the cartridge holder, and illustrates the wiping action of their respective electrical contacts as the cartridge is inserted in the cartridge holder.

Reference should now be made to FIG. 3 (comprising FIGS. 3A and 3B, which are isometric views of cartridges 20 as seen from the top rear and bottom front, respectively), which shows the three side-biased "datum" surfaces provided in the cartridge in addition to the above-mentioned datum surfaces 40, 44, 46, namely, three datum surfaces 54, 56, 58 on one side of cartridge 20, which cooperate to define an Y-Z orientation plane substantially perpendicular to the nozzle plane defined by nozzle plate 30 and substantially parallel to its Y axis. It will also be noted that vertical datum surface 44 is defined on a reenforcing bracket 62 integrally formed in the perimeter wall 64 of cartridge 20 at a juncture 66 of a downwardly facing surface 68 of the ink reservoir portion 70 and a forwardly facing portion 72 of the snout portion 74.

Figure 8:
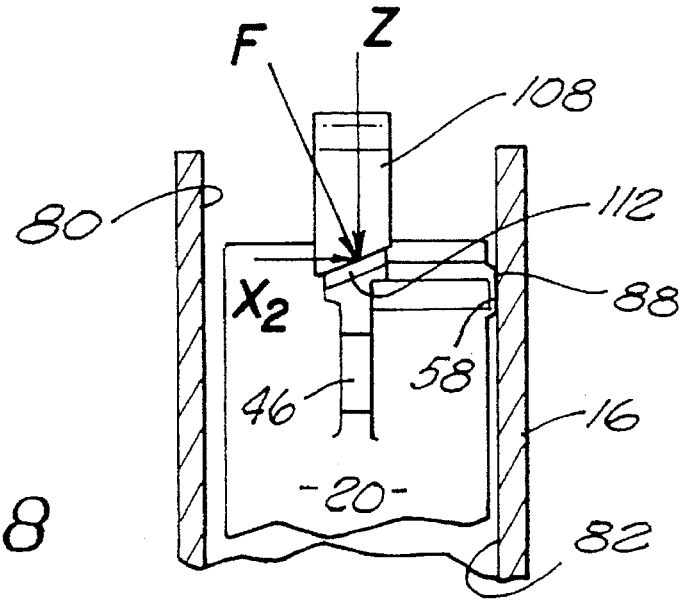
FIG. 8 is a rear view, partly in cross section, taken along line 8—8 of FIG. 7, and shows the two force components produced by the latch spring.

FIG. 3 also shows the various registration forces which when applied to the cartridge 20, serve to maintain these surfaces against corresponding registration features provided in the cartridge holder, namely a first sideways force X1 applied in the +X direction to the lower part of ink reservoir 70, a forward force Y applied in the +Y direction in the vicinity of electrical interface 52, and a third force F applied in the vicinity of upper rear datum surface 46 and upper side datum surface 58 and having a sideways component X2 in the +X direction and a downwards component Z in the –Z direction (see FIG. 8). It should be noted that the three side-biased datum surfaces 54, 56, 58 are located on the edge of the perimeter wall 64 of the cartridge 20, thereby providing additional rigidity and positional accuracy relative to the X axis, and are spaced apart from each other in the form of a triangle which surrounds the center of gravity CG of the cartridge, thereby facilitating a more accurate and stable alignment. Furthermore, since the downwards component Z of force F is offset horizontally in the +Y direction from horizontal datum surface 40 and associated supporting surface 42, the resultant counterforce from supporting surface 42 generates a net torque T which rotates cartridge 20 about pivot axis P, thereby forcing upper rear datum surface 46 into contact with sixth supporting surface 48. Because the pivot axis P (FIG. 5) is located above and in front of the snout 74, the electrical interface 52 at the lower rear of the cartridge 20 moves downwards as the cartridge is rotated rearwardly about the pivot axis P during installation, thereby producing an enhanced self-cleaning wiping action between the electrical contact surfaces on the cartridge and the cartridge holder. Moreover, even if force F has a relatively small component in the X direction, because it is at least as far above the center of gravity CG as is the center of gravity above the fulcrum defined by the two lower datum surfaces 54, 56, that relatively small force component will still suffice to prevent the cartridge from tipping sideways from an inertial force of more than twice its magnitude; in an exemplary embodiment, the mass of cartridge 20 is about 115 g and the maximum acceleration of movable carriage 12 is 1.5 g, which would require a force X2 (assuming zero friction) of about 1.75N, compared to an actual value (again assuming zero friction) of about 2.5N.

Of the various datum surfaces and their corresponding supporting surfaces, it should be understood that the most critical tolerances are associated with the two lower side-facing datum surfaces 54, 56 (which ensure that Y axes of the respective nozzle plates are parallel and accurately spaced apart) and with the lower vertical datum surface 44 (which ensures that all the X axes of the nozzle plates are aligned). In an exemplary embodiment, the cartridge 20 has a nominal height (not including snout portion 74) of 78 mm, a depth of 60 mm and a width of 19.18 mm; the nominal center-to-center spacing of the nozzle Y axes (and thus of the cartridges 20 and compartments 18) is 23.241 mm. High quality 4 color printing is obtained when each of the supporting surfaces 84, 86 is held to a tolerance of ±0.025 mm from its nominal spacing to the corresponding surface of an adjacent compartment 18 and the alignment of the three critical supporting surfaces 45, 84, 86 on cartridge holder 16 is such that they do not deviate more than ±0.0125 mm from a respective X-Z or Y-Z plane, and when the corresponding datum surfaces 44, 54, 56 of cartridge 20 do not deviate from the respective X-Z or Y-Z plane defined by the nozzle X and Y nozzle axes by more than ±0.020 mm.

Figure 6:
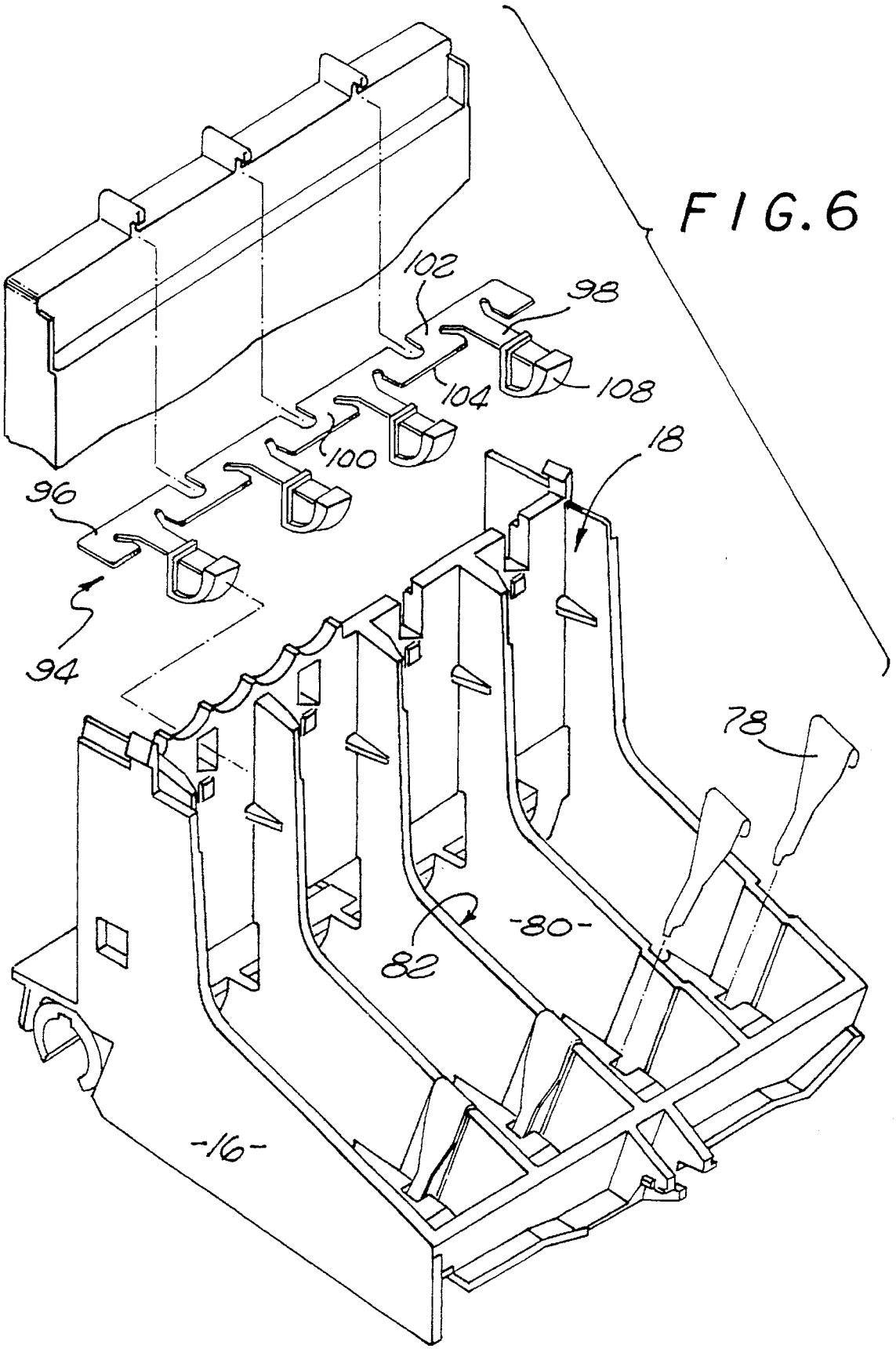
FIG. 6 is an exploded isometric view of the cartridge holder and the various springs which hold the cartridges with their respective datum surfaces in contact with the respective registration features provided in each compartment of the cartridge holder.
Figure 9:
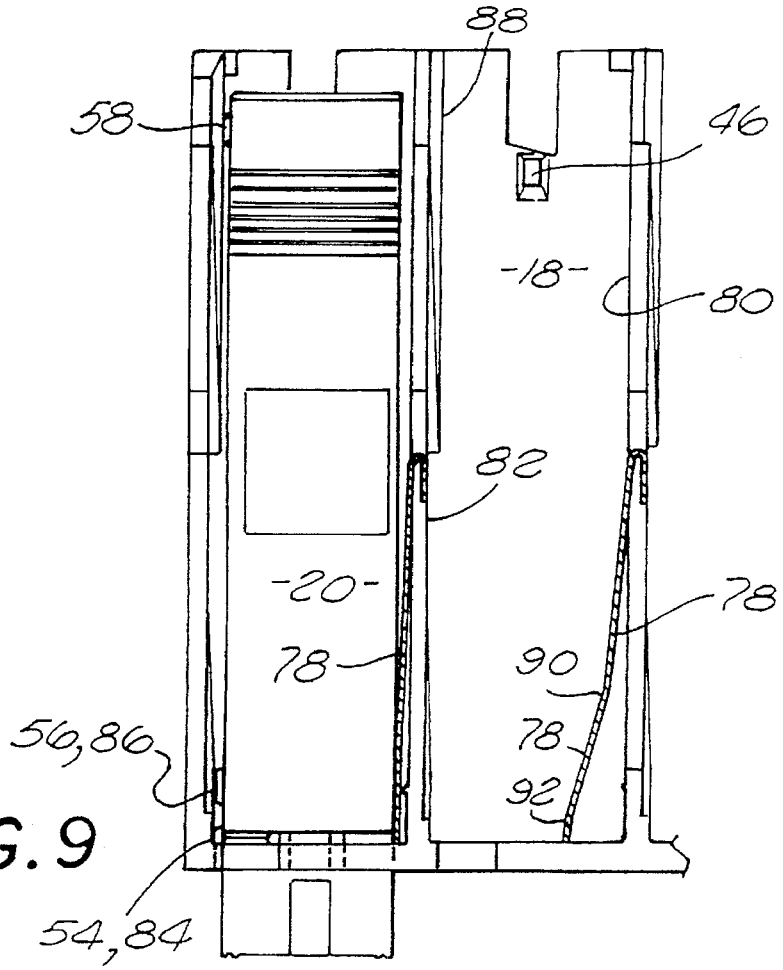
FIG. 9 is a front view, partly in cross section, of respective occupied and empty compartments of the cartridge holder, showing how a relatively thin cantilevered leaf spring provides a sideways bias force in the X axis at the lower end of the cartridge without adding unnecessary width to the cartridge holder.
Figure 10A:
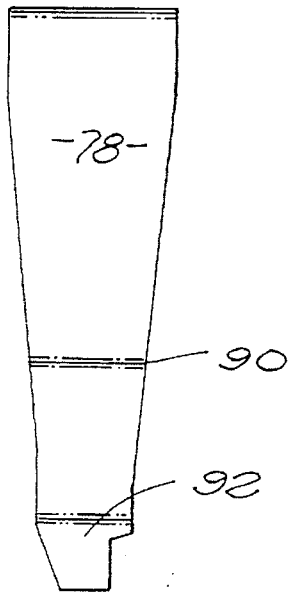
FIGS. 10A and 10B are respective side and front views of the leaf spring of FIG. 9.
Figure 10B:
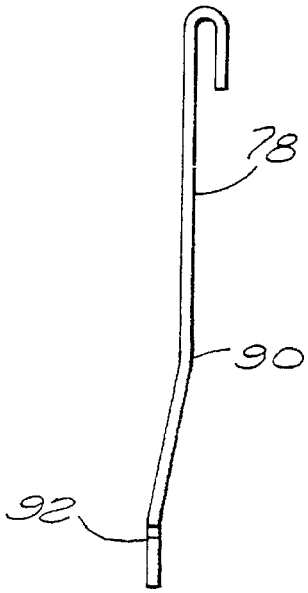

FIG. 6 is an exploded isometric view of the cartridge holder 16 and the various springs which hold the cartridges with their respective datum surfaces in contact with the respective registration features provided in each compartment of the cartridge holder. In particular it will be seen that a downwardly projected cantilevered leaf spring 78 is attached to a sidewall 80 of each cartridge compartment 18 opposite the sidewall 82 (FIG. 9) carrying the three supporting surfaces 84, 86, 88 corresponding to the three datum surfaces 54, 56, 58 (see FIG. 9), which provides the first sideways force X1. Leaf spring 78 is preferably manufactured from spring steel (for example 1050 steel) having a low friction corrosion-resistant coating (for example nickel), to minimize frictional forces between the surface of the spring and the lower edge of cartridge 20 opposite lower datum surfaces 54, 56, which otherwise would generate a countertorque about an axis defined by lower datum surfaces 54, 56 tending to oppose the sideways component X2 and might thus prevent cartridge 20 from assuming its desired orientation relative to the Y-Z plane defined by the three supporting surfaces 84, 86, and 88. As can best be seen in FIGS. 10A and 10B, which comprise respective side and front views of the leaf spring 78, in its uncompressed condition the main portion of leaf spring 78 does not lie flat against sidewall 80, but extends into the interior of compartment 18 at an angle of about 7½° and has a precision bend 90 of about 12° to thereby approximating a circular arc when uncompressed and, when fully compressed, a straight line parallel to sidewall 80 with lower end 92 in contact with the lower end of ink reservoir portion. Leaf spring 78 thus is capable of providing a substantial sideways bias force X1 of approximately 13N at the desired location without adding substantial width to the cartridge holder 16.

The upper portion of FIG. 6 shows a latch assembly 94 for securing all four cartridges 20 inside their respective cartridge compartments 18 of cartridge holder 16. Latch assembly 94 comprises a metallic spring 96 stamped from full hard stainless steel, and comprises four forwardly facing latch ends 98 separated by five respective forwardly facing supporting ends 100. Preferably, each latch end 98 is connected to its two adjacent supporting ends 100 by a serpentine arm 102 defined by suitable radiused cutouts in stamped spring 96 to provide a shape that approximates a constant stress geometry. Each supporting end 100 is terminated by straight edge 104 which is inserted into a corresponding slot 106 (FIG. 7) at the upper rear of cartridge holder 16; because latch assembly 94 is a single unit, only one assembly operation is required for all four cartridge compartments 18. Because of the serpentine shape of the individual serpentine arm 102, it is possible to provide a spring that is relatively compact from front to rear and yet provides a relatively substantial constant force (of approximately 17.3N) over a relatively large deflection range. This compactness contributes in turn to the overall compactness of cartridge holder 16 and thus of inkjet printer 10.

Figure 7:
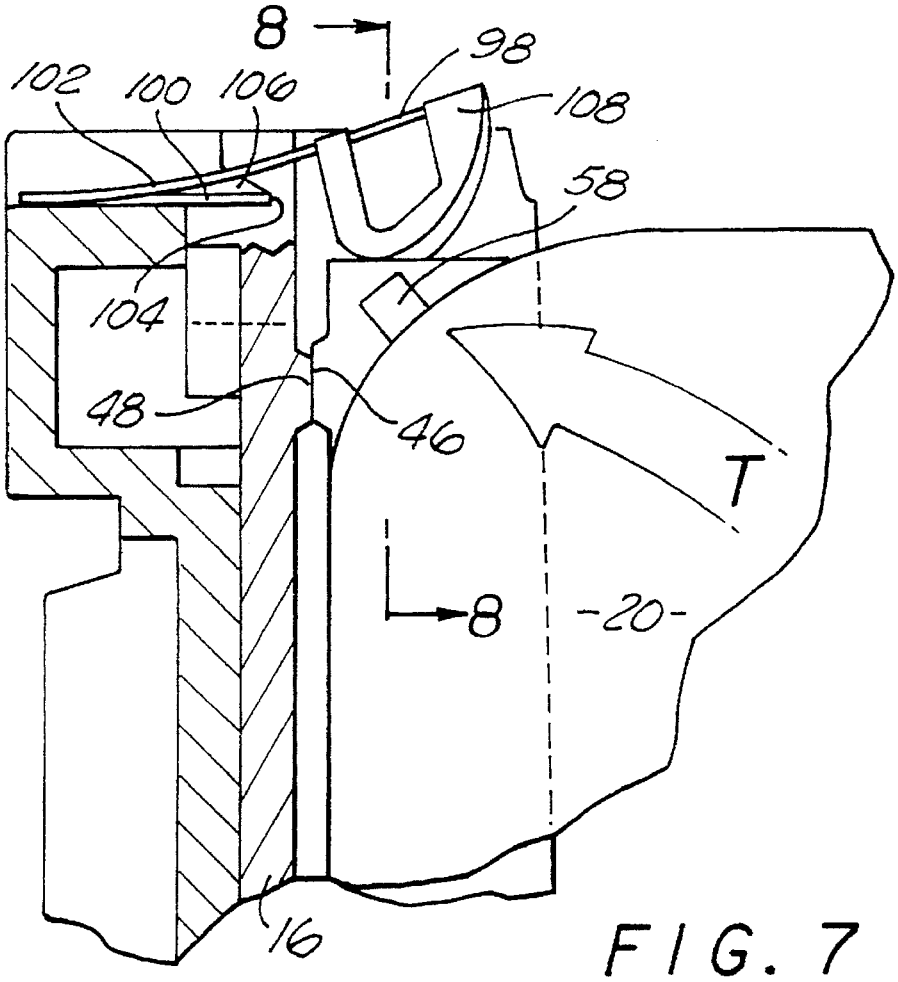
FIG. 7 is a side view, partly in cross section, of the upper rear portion of the cartridge and cartridge holder, showing the cam of the latching spring in contact with a corresponding lip at the top of the cartridge to thereby provide a compound registration force having components in the X and Z axes.

Each latch end 98 is provided with a cam 108 preferably molded of a low friction material such as PTFE filled acetal (in the ratio of 20% PTFE, 80% acetal), which has a coefficient of friction substantially lower than the coefficient of friction of the stainless steel component of the spring. As shown in FIGS. 6, 7 and 8, each molded cam 108 is shaped in the form of a horizontal section of an inclined, sideways oriented cylinder (ie, a cylinder having its axis parallel to the X axis and tilted about the Y axis). As is best shown in FIG. 8, a lower tangential plane formed by the cylindrical surface intersects the plane of the latch end 98 at an oblique angle of about 15.6°, which is complementary to a corresponding oblique surface 112 of a reenforced lip 114 formed on perimeter wall 64 of cartridge 20 between upper rear datum surface 46 and upper side datum surface 58, thereby producing the sideways component X2 of force F, with the low coefficient of the molded plastic material resulting in a greater net sideways force X2 for a given force F.

When a cartridge 20 is inserted into the cartridge compartment 18 (see also FIGS. 2 and 4) the low coefficient of friction of molded cam 108 permits it to slip over oblique surface 112. Thereupon, serpentine arm 102 exerts a downward force Z and sideways force X2 which through the curved surface onto the cartridge. The downward Z force presses the cartridge 20 downward onto the carriage until it contacts horizontal supporting surface 42, while force Y (11N in an exemplary embodiment) produced by electrical interface 52 presses vertical datum surface 44 against vertical supporting surface 45. As noted previously, since the downwards component Z of force F is offset horizontally in the +Y direction from horizontal datum surface 40 and associated supporting surface 42, the resultant counterforce from supporting surface 42 generates a net torque T (FIG. 7) which rotates cartridges 20 about pivot axis P, thereby forcing upper rear datum surface 46 into contact with sixth supporting surface 48, while the sideways bias force X2 presses upper side datum surface 58 against upper side supporting surface 88 (FIG. 8).

It is understood that the above-described embodiment is merely provided to illustrate the principles of the present invention, and that other embodiments may readily be devised using these principles by those skilled in the art without departing from the scope and spirit of the invention.

What is claimed is:

1. In an inkjet printer comprising:

a movable carriage supported above an ink-receiving medium by a rail defining a transverse printer axis;

a cartridge holder mounted on the cartridge and having a plurality of cartridge compartments each spaced a predetermined transverse spacing from an adjacent one of the cartridge compartments, each cartridge compartment being separated from an adjacent compartment by a lateral compartment wall perpendicular to the transverse printer axis;

a plurality of thermal ink jet printer cartridges each having a downwardly facing nozzle plate, and a lateral cartridge wall perpendicular to the nozzle plate, and means for orienting the nozzle plate of each cartridge in a predetermined orientation relative to the nozzle plates of the other cartridges, including a predetermined vertical position, a predetermined side-to-side position, a predetermined front-to-back position, a predetermined pitch angle about a side-to-side axis, a predetermined yaw angle about a vertical axis, and a predetermined roll angle about a front-to back axis, wherein the nozzle plates are parallel to the print medium and spaced therefrom by a predetermined vertical spacing, the side-to-side axes of the cartridges are co-linear and parallel to the transverse axis of the printer, and the front-to back axes of the cartridges are spaced apart from each other by the predetermined transverse spacing;

the improvement wherein:

co-planar first, second, and third datum surfaces are defined on the same lateral cartridge wall of each cartridge in predetermined positions above and to one side of the nozzle plate to thereby form three vertices of a triangle, with the first and second datum surfaces being disposed on a lower portion of the cartridge below a predetermined center of gravity, the first datum surface being disposed in front of the nozzle plate, the second datum surface being disposed behind the nozzle plate, and the third datum surface being disposed on an upper portion of the cartridge above the center of gravity, three co-planar supporting surfaces corresponding to the three co-planar datum surfaces are defined on the same lateral compartment wall of each compartment, with the corresponding datum surfaces in adjacent compartments being transversely aligned and separated by the predetermined transverse spacing, and a lateral force is exerted on each cartridge to hold the three co-planar datum surfaces against the three respective supporting surfaces, whereby the three co-planar supporting surfaces cooperate with the three co-planar datum surfaces to maintain the side-to-side axes parallel to the transverse axis of the printer and the front-to back axes spaced apart from each other by the predetermined transverse spacing.

2. The improvement of claim 1, wherein all the co-planar datum surfaces are defined on a perimeter wall surrounding the lateral wall and the lateral force includes a first component applied to the perimeter wall between the first and second datum surfaces and a second component applied to the perimeter wall adjacent the third datum surface.

3. The improvement of claim 1, wherein each of the cartridges further comprises a fourth datum surface on a intermediate vertical plane perpendicular to the front-to-back cartridge axis and intersecting the lateral cartridge wall between the first and second datum surfaces, the first vertical plane being disposed in front of the nozzle plate and spaced from the side-to-side cartridge axis by a front-to-back spacing, the fourth datum surface being disposed above the nozzle plate and below the center of gravity, a fifth datum surface on a horizontal plane parallel to the side-to-side axis and to the front-to-back axis and between the fourth datum surface and the center of gravity, and a sixth datum surfaces on a mar vertical plane parallel to the intermediate vertical plane and perpendicular to the horizontal plane, the sixth datum surface being disposed above the center of gravity adjacent the third datum surface, each of the compartments is provided with fourth, fifth and sixth respective supporting surfaces corresponding to the fourth, fifth and sixth datum surfaces of each respective cartridge, a back-to-front force component is exerted on the lower portion of each cartridge to hold the fourth datum surfaces of each of the cartridges against the fourth supporting surfaces of the respective cartridge compartment, to thereby maintain the predetermined front-to back position, a downwards force component is exerted on each cartridge to hold the fifth datum surfaces of each of the cartridges against the fifth supporting surfaces of the respective cartridge compartment, to thereby maintain the vertical position, and a front-to back force component is exerted on an upper portion of each cartridge to hold the sixth datum surface of each of the cartridges against the sixth supporting surface of the respective cartridge compartment, which cooperates with the back-to-front force component holding the fourth datum surface against the fourth supporting surface to maintain the predetermined pitch angle of the cartridge.

4. The improvement of claim 1, wherein all the side-to-side axes are co-linear, all the intermediate vertical planes lie in a common intermediate vertical plane, all the rear vertical planes lie in a common rear vertical plane, and all the horizontal planes lie in a common horizontal plane.

5. The printer of claim the improvement of claim 3, wherein the respective nozzles of all of the cartridges are straddled by front and rear feed rollers to maintain a print medium in a taut condition as the print medium passes under the nozzles, one of the feed rollers being disposed between a lower surface of the carriage below the fifth supporting surface and an upper surface of the print medium adjacent the nozzle plates.

6. The printer of claim the improvement of claim 3, wherein the fourth and fifth supporting surfaces cooperate with the fourth and fifth datum surfaces to define a pivot axis parallel to the traverse printer axis and in front of and above the nozzle plate.

7. The printer of claim the improvement of claim 6, wherein an external vertical force is exerted on each of the cartridges adjacent to the respective sixth datum surface which produces a torque about the pivot axis which in turn results in the front-to-back force component being exerted on upper portion of the cartridge.

8. The printer of claim the improvement of claim 7, wherein:

each the cartridge includes a respective electrical interface disposed on the rear vertical plane adjacent the nozzle plate, and the rear-to-front force is applied against the electrical interface.

9. A thermal ink jet printer cartridge having a downwardly facing nozzle plate disposed on a first horizontal plane, a lateral wall on one side of the nozzle plate and perpendicular to the first horizontal plane, co-planar first, second and third datum surfaces defined on the same lateral cartridge wall of each cartridge in predetermined positions above and to one side of the nozzle plate to thereby form three vertices of a triangle, with the first and second datum surfaces being disposed on a lower portion of the cartridge below a predetermined center of gravity, the first datum surface being disposed in front of the nozzle plate, the second datum surface being disposed behind the nozzle plate, and the third datum surface being disposed on an upper portion of the cartridge above the center of gravity, a fourth datum surface on a first vertical plane intersecting the lateral cartridge wall between the first and second datum surfaces in front of the nozzle plate, the fourth datum surface being disposed above the nozzle plate and below the center of gravity, a fifth datum surface on a second horizontal plane above the first horizontal plane and located between the fourth datum surface and the center of gravity, and a sixth datum surfaces on a second vertical plane behind the first vertical plane, the sixth datum surface being disposed above the center of gravity and adjacent the third datum surface.

10. The cartridge of claim 9 further comprising a perimeter wall intersecting the lateral wall at an outer perimeter of the cartridge, wherein the co-planar first, second and third datum surfaces are defined on the perimeter wall at the outer perimeter of the lateral wall.

11. The cartridge of claim 9 wherein the intersection of the first vertical plane and the second horizontal plane defines a cartridge pivot axis in front of and above the nozzle plate.

12. The cartridge of claim 9, wherein:

each cartridge includes a rearwardly facing electrical interface disposed on the second vertical plane adjacent the nozzle plate.

* * * * *

UNITED STATES PATENT AND TRADEMARK OFFICE

CERTIFICATE OF CORRECTION

PATENT NO : 5,646,665

DATED : July 8, 1997

INVENTOR(S) : Swanson et al.

It is certified that error appears in the above-identified patent and that said Letters Patent is hereby corrected as shown below:

At Column 1, line 66, delete "inkier" and insert in lieu thereof --inkjet--.

At Column 7, line 33, after "mounted on the," delete "cartridge" and insert--carriage--.

At Column 8, line 40, delete "mar" and insert in lieu thereof --rear--.

Signed and Sealed this

Tenth Day of February, 1998

*Attest:*

Bruce Lehman

BRUCE LEHMAN

*Attesting Officer*

*Commissioner of Patents and Trademarks*